US008556675B2

(12) United States Patent
Gonzalez

(10) Patent No.: US 8,556,675 B2
(45) Date of Patent: Oct. 15, 2013

(54) BALLOON TOY AND METHOD OF USE

(76) Inventor: Alejandro Doring Gonzalez, La Jolla, CA (US)

( * ) Notice: Subject to any disclaimer, the term of this patent is extended or adjusted under 35 U.S.C. 154(b) by 171 days.

(21) Appl. No.: 13/346,956

(22) Filed: Jan. 10, 2012

(65) Prior Publication Data

US 2013/0178132 A1 Jul. 11, 2013

(51) Int. Cl.
*A63H 33/00* (2006.01)

(52) U.S. Cl.
USPC ..... 446/220

(58) Field of Classification Search
USPC ..... 446/220
See application file for complete search history.

(56) References Cited

U.S. PATENT DOCUMENTS

| | | | | |
|---|---|---|---|---|
| 3,202,378 | A * | 8/1965 | Williamson | 242/390.8 |
| 3,592,157 | A * | 7/1971 | Schwartz | 340/815.74 |
| 3,593,940 | A | 7/1971 | Stanton | |
| 3,822,839 | A * | 7/1974 | Persichini | 242/390.8 |
| 4,729,750 | A * | 3/1988 | Prusman | 446/225 |
| 5,071,085 | A | 12/1991 | Beers | |
| 5,238,200 | A | 8/1993 | Ritzenthaler | |
| 5,947,790 | A | 9/1999 | Gordon | |
| 7,674,152 | B2 * | 3/2010 | Anderson | 446/220 |

FOREIGN PATENT DOCUMENTS

| | | |
|---|---|---|
| EP | 1427632 | 1/2005 |
| JP | 06-017508 | 5/1994 |
| JP | 3010385 | 2/1995 |
| JP | 08-266747 | 10/1996 |

OTHER PUBLICATIONS

Notification, International Search Report and Written Opinion dated Mar. 19, 2013 for PCT/US2012/69004.

* cited by examiner

*Primary Examiner* — Michael Dennis
(74) *Attorney, Agent, or Firm* — Stephen C. Beuerle; Procopio Cory Hargreaves & Savitch LLP

(57) ABSTRACT

A balloon toy includes a helium-filled balloon; a balloon string tethered to the balloon; and a balloon raising and lowering assembly including: a housing including a handle; a balloon string reel rotatably carried within the housing and carrying the balloon string; an electric motor carried within the housing; a power source carried within the housing for powering the electric motor; a gear assembly including a plurality of gears carried with the housing and operable coupling the electric motor to the balloon string reel for driving rotation of the balloon string reel; a biasing member including a biasing force that urges the gear assembly together so that the plurality of gears are engaged for driving rotation of the balloon string reel for drawing in the balloon string and helium-field balloon and allows the plurality of gears to slip relative to each other if tension on the balloon string is too high.

9 Claims, 4 Drawing Sheets

BALLOON TOY AND METHOD OF USE

BACKGROUND

1. Field of the Invention

The present invention is in the field of balloon toys for helium-filled balloons.

2. Related Art

Balloons filled with helium are widely used for children's enjoyment. In general, these balloons are not offered with any other purpose or additional potential other than a weight so the balloon will not fly away.

SUMMARY OF THE INVENTION

Accordingly, an aspect the invention involves a balloon toy that increase a child's enjoyment of a helium-filled balloon. The balloon toy can be held by the child and is simple and easy to operate. The balloon toy includes an elongated housing with a small aperture at a front end where a balloon string attached to a helium-field balloon protrudes. The housing carries a power source in a handle of the housing near its rear end. The power source powers a motorized reel assemblage within the housing adjacent its front end. An UP/DEFAULT-BRAKE/DOWN switch is used to activate and deactivate the power source for powering the internal motorized reel. The balloon toy enhances the pleasure of having a helium-filled balloon through the internal motorized reel in the toy that releases or retracts the balloon string, allowing the child to control the altitude of the balloon by lengthening and shortening the length of the balloon string with the push of a button on the toy. The balloon toy is light-weight and its size is easily grasped by a child's hand. This balloon toy will animate amusement parks in general as balloons will change constantly on the horizon as multiple users engage in its use.

One or more implementations of the above aspect of the invention include one or more of the following: the power source comprises an electrical battery pack and motor; the power source is provided by a solar panel and motor; the motorized reel assembly includes a spool on a fixed anchor that turns in tandem with the motor by means of a band and sprockets; the activation and deactivation is in the form of a DPDT electrical switch; and/or the activation and deactivation is in the form of a simple switch for the motor and a gear release function on the switch.

Another aspect of the invention involves a balloon toy including a mechanism which allows the release of the helium-filled balloon at different speeds and prevents the release of the string from backing up in the housing and snagging. The balloon is returned to the user in a fast-motorized manner that can be controlled by starting or stopping the motor and thus controlling the return rate of the balloon. A return gear of the motor is biased into gear engagement by a spring so that if the balloon encounters high winds or a tree branch, the return gear disengages (i.e., gears slip relative to each other) so that the motor will not immediately compromise the balloon string and cause it snap. This spring-engaged gear also prevents the motor from burning out with no movement of the string (e.g., if the balloon encounters high winds or a tree branch), which lengthens the life of the motor.

The user can then wait to remedy the undesirable condition.

A further aspect of the invention involves a balloon toy including a helium-filled balloon; a balloon string tethered to the balloon; and a balloon raising and lowering assembly including: a housing including a handle; a balloon string reel rotatably carried within the housing and carrying the balloon string; an electric motor carried within the housing; a power source carried within the housing for powering the electric motor; a gear assembly including a plurality of gears carried with the housing and operable coupling the electric motor to the balloon string reel for driving rotation of the balloon string reel; a biasing member including a biasing force that urges the gear assembly together so that the plurality of gears are engaged for driving rotation of the balloon string reel for drawing in the balloon string and helium-field balloon and allows the plurality of gears to slip relative to each other if tension on the balloon string is too high.

One or more implementations of the aspect of the invention described immediately above include one or more of the following: the balloon toy includes an UP mode where the helium-filled balloon rises, causing the balloon string reel to rotate in a first direction to let out the balloon string and the helium-filled balloon, the balloon toy further including a stop system that allows rotation of the balloon string reel in the first direction and prevents significant rotation of the balloon string reel in a second direction opposite to the first direction, preventing recoil of the balloon string on the balloon string reel as the helium-filled balloon rises; the balloon toy includes a DOWN mode where the stop system is disengaged and the electric motor is actuated, causing the balloon string reel to rotate in the second direction to draw in the balloon string and the helium-filled balloon; the balloon toy includes a BRAKE mode where the stop system is disengaged and the plurality of gears are engaged so that balloon string is not drawn out from the balloon string reel and the balloon string reel does not rotate unless tension on the balloon string is high enough to cause the plurality of gears to slip relative to each other; and/or the balloon toy includes a rocker switch having at least the UP mode, the DOWN mode, and the BRAKE mode, which are mutually exclusive.

A further aspect of the invention involves a method of using a balloon toy including descending the helium-filled balloon by drawing in the balloon string and helium-filled balloon by rotating the balloon string reel through the electric motors and gear assembly; and urging the gear assembly together with a force sufficient for engaging the plurality of gears together for driving rotation of the balloon string reel for drawing in the balloon string and helium-field balloon and sufficient for allowing the plurality of gears to slip relative to each other if tension on the balloon string becomes too high.

One or more implementations of the aspect of the invention described immediately above include one or more of the following: the method further includes ascending the helium-filled balloon by letting out the balloon string from the balloon string reel and rotating the balloon string reel in a direction opposite to a direction for drawing in the balloon string; and preventing significant rotation of the balloon string reel in the direction for drawing in the balloon string and recoiling of the balloon string on the balloon string reel as the helium-filled balloon rises with a stop system; the method further includes actuating a DOWN mode in the balloon toy, the DOWN mode disengaging the stop system and actuating the electric motor to cause the balloon string reel to rotate to draw in the balloon string and the helium-filled balloon; the method further includes actuating a BRAKE mode in the balloon toy, the BRAKE mode disengaging the stop system and engaging the plurality of gears so that balloon string is not drawn out from the balloon string reel and the balloon string reel does not rotate unless tension on the balloon string is high enough to cause the plurality of gears to slip relative to each other; and/or the balloon toy includes a rocker switch having at least the UP mode, the DOWN mode, and the BRAKE mode, which are mutually exclusive, and the method further includes moving the switch to one of the UP mode, the DOWN mode, and the BRAKE mode.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a balloon toy 100 and method of use.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

Figure 1:
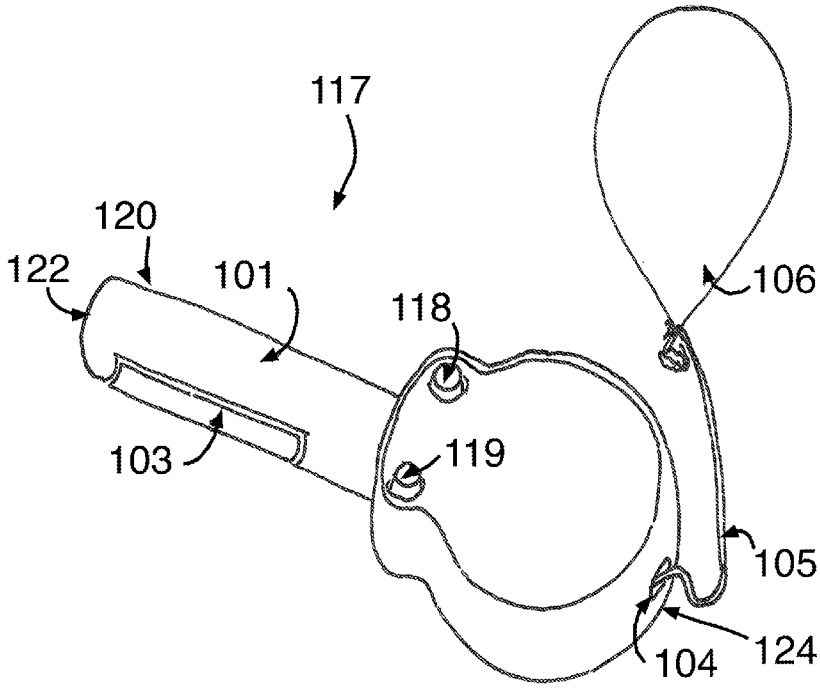
FIG. 1 is a perspective view of an embodiment of a balloon toy.
Figure 2:
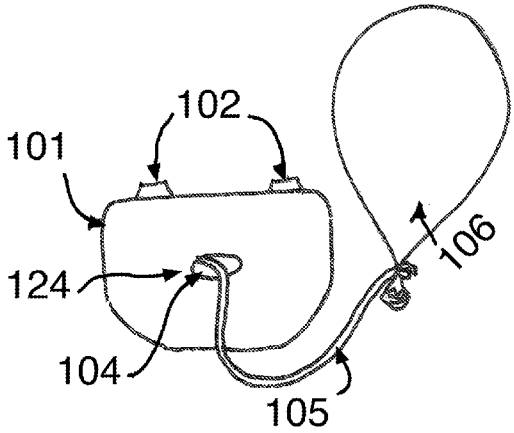
FIG. 2 is a right side elevational view of the balloon toy of FIG. 1.
Figure 3:
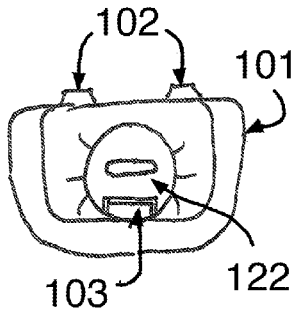
FIG. 3 is a left side elevational view of the balloon toy of FIG. 1.

With reference initially to FIGS. 1-3, the balloon toy 100 includes a balloon raising and lowering assembly 117 including a housing or casing 101, an UP/DEFAULT-BRAKE/DOWN switch 102 with push buttons 118, 119, a battery access door 103 in a handle 120 near a near rear end 122 of the housing 101, an opening or small aperture 104 at a front end 124 of the housing 101, a balloon string 105, and a helium-filled balloon 106. Although the housing 101 is shown as heaving a substantially guitar-like configuration, in one or more additional embodiments, the housing 101 may have an alternative configuration to make the toy 100 have an appearance of a cartoon character or any other pleasant form that a child will enjoy.

Figure 4:
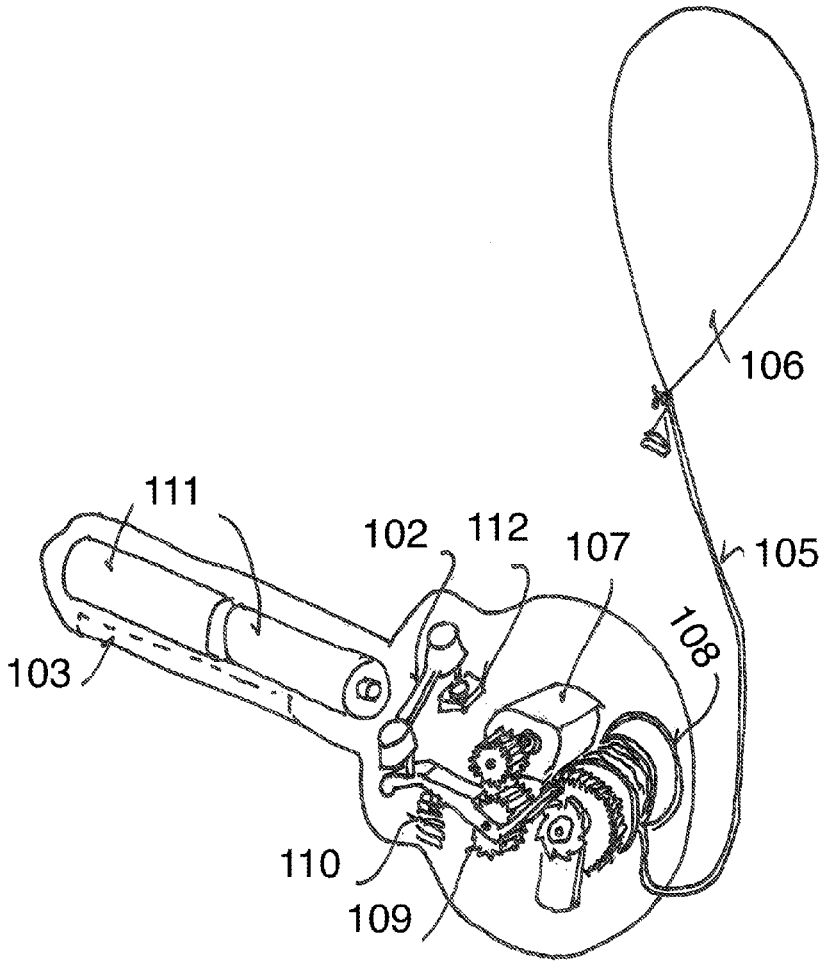
FIG. 4 is a cut-away simple perspective view of the balloon toy of FIG. 1 and shows the components with a housing of the balloon toy.
Figure 5:
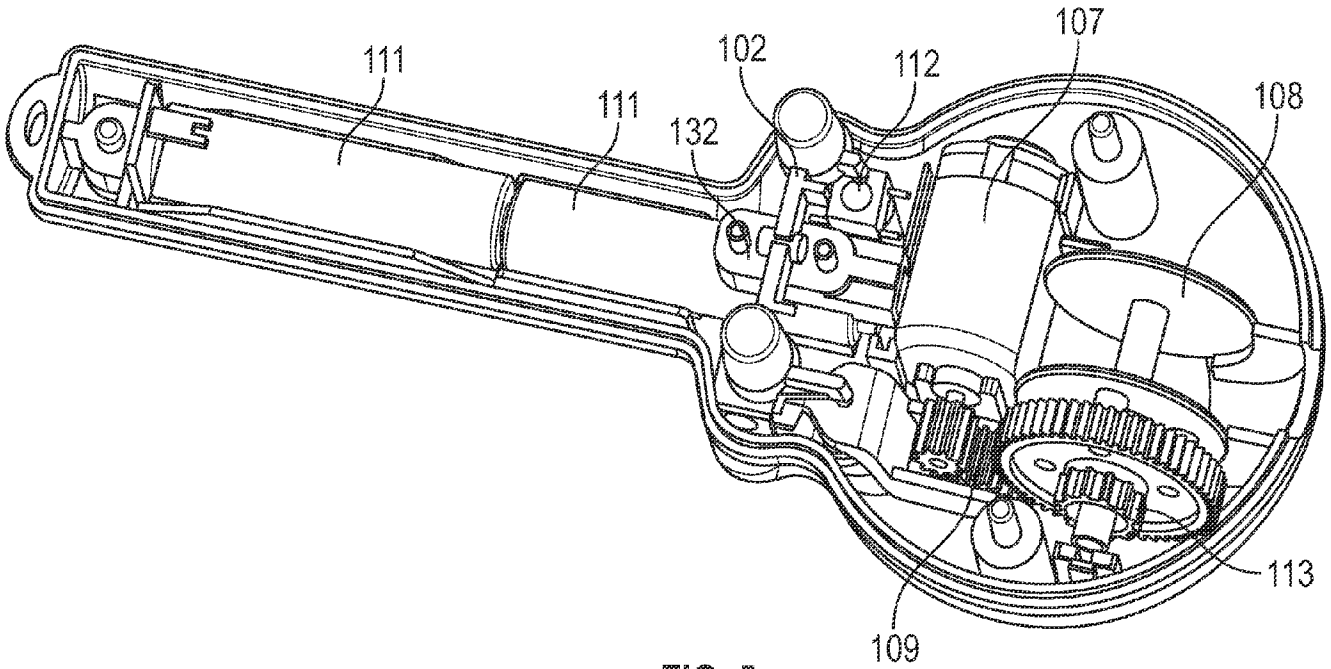
FIG. 5 is another cut-away perspective view of the balloon toy of FIG. 1, showing the components in the housing of the balloon toy.
Figure 6:
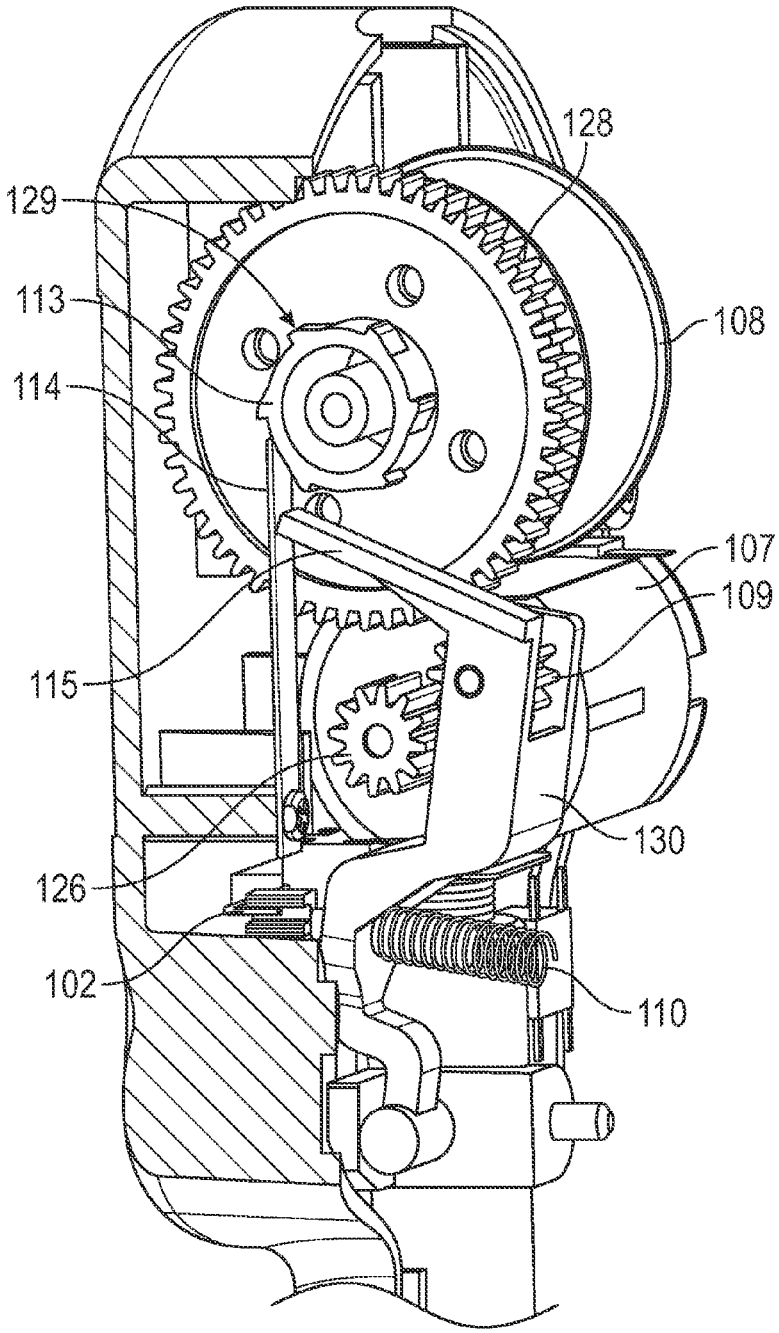
FIG. 6 is a cut-away, partial perspective view of the balloon toy of FIG. 1, showing the components in the housing of the balloon toy.

With reference to FIGS. 4-6, the internal components of the balloon toy 100 carried within the housing 101 will be described. The balloon toy 100 includes a motor 107 that drives a drive gear 126, a string reel 108 (e.g., holding about 200-300 ft of string) with string wheel gear 128 and annular stop mechanism 129 having protruding curved stop fingers 113 to prevent string snagging, a spring-biased intermediate gear 109, a biasing mechanism 130, a spring 110, power source/one or more batteries 111 (e.g., AAA 1.5 volt batteries), an electric on/off switch 112, a stop tab 114, and a stop-release tab 115.

In one or more additional embodiments, the location of one or more of the motor 107, the reel 108, the switch 102, and/or the one or more batteries 111 can be other than that shown herein.

Except for the conducting metals in the motor 107 and the one or more batteries 111, the materials used to fabricate the balloon toy 100 are provided from any suitable source such as, but not limited to, metal, wood, plastics, and the like as well as a combination thereof. Preferably, durable and lightweight plastic materials are preferred such as, but not limited to, high density polyethylene, polypropylenes, polysulfones, and polystyrenes.

The balloon toy 100 will now be described in use. The motor 107 is controlled by the external switch 102 to control the string reel 108. The switch 102 also has a gear-release function to allow the helium-filled balloon to lift and draw out the string 105 from the reel 108. When the DOWN button 118 of the switch 102 is pressed, the on/off switch 112 is activated, causing the motor 107 to rotate drive gear 126. Because intermediate gear 109 is biased against the drive gear 126 and the string reel gear 128 by the biasing mechanism 130 via the spring 110, the intermediate gear 109 is engaged with the other gears 126, 128 so that motor rotation causes the reel 108 to rotate and retract the string 105 onto the reel 108 and into the front end 124 of the housing 101, through the aperture 104. As the reel 108 retracts the string 105, the helium-filled balloon 106 exerts pressure on the string 105. In this mode, the biasing mechanism 130 urges (via the spring 110) stop-release tab 115 against the stop tab 114, causing the stop tab 114 to disengage/clear the protruding curved stop fingers/stops 113 of the annular stop mechanism 129. This allows the reel 108 and annular stop mechanism 129 to freely rotate counter clockwise in FIG. 6 to draw the string 105 in. The amount of biasing force in the biasing mechanism 130 (via the spring 110) is such that the gears (and/or teeth of the gears) 109, 126, 128 slip relative to each other in the event of a high-tension condition in the string 105 (e.g., high-tension in the string 105 caused by high winds, the balloon 106 being caught, the balloon 106 being completely drawn into the toy 100, etc.) because the tension force on the balloon 106 and string 105 (e.g., from the high wind) can be greater than the strength of the motor 107, which would compromise (e.g., burn out) the motor 107. The biasing mechanism 130 solves this problem because it allows the gears 109, 126, 128 to slip if the tension is too great. The user can then decide to wait for the high-tension condition to stop (e.g., wind to die down) or decide to use other means to retract the balloon 106 such as manually. When the gears 109, 126, 128 slip relative to each other, they make a noise, which also serves as an alarm to the user that the gears 109, 126, 128 are slipping and to stop pressing the "DOWN" button 119.

The switch 102 also has a "DEFAULT" or "BRAKE" position/mode when the DOWN button 118 is not pressed and the UP button is not pressed (i.e., no pressure from the user, which keeps the string reel stationary), where the user can elect the height at which to leave the balloon 106 in the air. In this DEFAULT-BRAKE mode, because intermediate gear 109 is biased against the drive gear 126 and the string reel gear 128 by the biasing mechanism 130 via the spring 110, the intermediate gear 109 is engaged with the other gears 126, 128 but the motor is not rotating. As a result, this gear engagement functions as a brake so that the string reel 108 is substantially locked into position so that the length of the string 105 drawn out from the reel 108 is at a desired length and the balloon 106 stays at a desired height. As mentioned above, if a high-tension condition occurs in the balloon 106/string 105 (e.g., high-tension in the string 105 caused by high winds, the balloon being caught, etc.), the biasing mechanism 130 solves this problem because it allows the gears 109, 126, 128 to slip if the tension is too great. The user can then decide to wait for the high-tension condition to stop (e.g., wind to die down) or decide to use other means to retract the balloon 106 such as manually. Similar to the DOWN condition/position, in the DEFAULT-BRAKE condition, the biasing mechanism 130 urges (via the spring 110) stop-release tab 115 against the stop tab 114, causing the stop tab 114 to disengage/clear the protruding curved stop fingers/stops 113 of the annular stop mechanism 129.

The switch 102 also has UP or release button/function 119 that when pressed allows the balloon 106 to lift and the string 105 to draw out from the reel 108 by the pull of the helium-filled balloon. By pressing on the UP button 119, the user has complete control of how much string 105 the user wants drawn out from the reel 108 (and the height at which the balloon 106 can fly) limited to the length of the string 105 provided. Pressing on the UP or release button moves the biasing mechanism 130 and the stop-release tab 115 down/away from the stop tab 114, causing the stop tab 114 to ride along rotation of the annular stop mechanism 129. This allows the reel 108 and annular stop mechanism 129 to freely rotate clockwise in FIG. 6 to release the string 105 out in one direction only as the balloon pulls on the string 105. The annular stop mechanism 129 and stop tab 114 (i.e., stop system) prevents the recoil of the string 105 as the helium-filled balloon 106 is released by its own power/pull. The stop tab 114 is activated and engages the protruding curved stop fingers/stops 113 of the annular stop mechanism 129 only if the reel 108 recoils in the wrong direction. As mentioned above, the stop-release tab 115 disengages the stop system 114, 129 when the motor 107 is actuated because the reel 108/annular stop mechanism 129 moves in the direction of (against) the stop top 114 when engaged by the motor 107. The stop system may be referred to as a "feather weight" stop system because the force of the stop tab 114 on the annular stop mechanism 129 is so low/light, that the reel 108 is easily rotated and the string 105 drawn out by the light pull of the helium-filled balloon 106.

The UP/DEFAULT-BRAKE/DOWN switch 102 prevents the operator from making a mistake because the "UP", "DEFAULT-BRAKE", and "DOWN" positions are the switch 102 are mutually exclusive. Once can not activate one of these conditions/positions without deactivating the other two. The switch 102 is a single-piece rocker style switch with UP button 118 and DOWN button 119 connected by rocker/see saw 132 so that only UP position/mode or DOWN position/mode can be activated at a time. A spring urges the switch 102 into the DEFAULT/BRAKE ON position/mode, which is in the middle/horizontal orientation of the rocker/see saw 132 (neither UP nor DOWN are active in this position). The user can only push UP button 118 or DOWN button 119 temporarily because letting go of either button 118, 119 causes that respective function to cease and the rocker switch 102 moves to the middle/horizontal orientation (DEFAULT-BRAKE condition).

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

I claim:

1. A balloon toy, comprising:

a helium-filled balloon;

a balloon string tethered to the balloon; a balloon raising and lowering assembly including:

a housing including a handle;

a balloon string reel rotatably carried within the housing and carrying the balloon string;

an electric motor carried within the housing;

a power source carried within the housing for powering the electric motor;

a gear assembly including a plurality of gears carried with the housing and operable coupling the electric motor to the balloon string reel for driving rotation of the balloon string reel;

a biasing member including a biasing force that urges the gear assembly together so that the plurality of gears are engaged for driving rotation of the balloon string reel for drawing in the balloon string and helium-field balloon and allows the plurality of gears to slip relative to each other if tension on the balloon string is too high, wherein the balloon toy includes an UP mode where the helium-filled balloon rises causing the balloon string reel to rotate in a first direction, a stop system that allows rotation of the balloon string reel in the first direction and prevents significant rotation of the balloon string reel in a second opposite direction, a DOWN mode where the stop system is disengaged and the electric motor is actuated, causing the balloon string reel to rotate in the second direction, and a BRAKE mode where the stop system is disengaged and the plurality of gears are engaged so that balloon string is not drawn out from the balloon string reel and the balloon string reel does not rotate unless tension on the balloon string is high enough to cause the plurality of gears to slip relative to each other.

2. The balloon toy of claim 1, wherein in the UP mode the helium-filled balloon rises, causing the balloon string reel to rotate in a first direction to let out the balloon string and the helium-filled balloon, the balloon toy further including a stop system that allows rotation of the balloon string reel in the first direction and prevents significant rotation of the balloon string reel in a second direction opposite to the first direction, preventing recoil of the balloon string on the balloon string reel as the helium-filled balloon rises.

3. The balloon toy of claim 2, wherein in the DOWN mode the stop system is disengaged and the electric motor is actuated, causing the balloon string reel to rotate in the second direction to draw in the balloon string and the helium-filled balloon.

4. The balloon toy of claim 1, wherein the balloon toy includes a rocker switch having at least the UP mode, the DOWN mode, and the BRAKE mode, which are mutually exclusive.

5. A method of using a balloon toy, comprising:

providing a helium-filled balloon comprising;

a balloon string tethered to the balloon; a balloon raising and lowering assembly including:

a housing including a handle;

a balloon string reel rotatably carried within the housing and carrying the balloon string;

an electric motor carried within the housing;

a power source carried within the housing for powering the electric motor;

a gear assembly including a plurality of gears carried with the housing and operable coupling the electric motor to the balloon string reel for driving rotation of the balloon string reel;

a biasing member including a biasing force that urges the gear assembly together so that the plurality of gears are engaged for driving rotation of the balloon string reel for drawing in the balloon string and helium-field balloon and allows the plurality of gears to slip relative to each other if tension on the balloon string is too high, wherein the balloon toy includes an UP mode where the helium-filled balloon rises causing the balloon string reel to rotate in a first direction, a stop system that allows rotation of the balloon string reel in the first direction and prevents significant rotation of the balloon string reel in a second opposite direction, a DOWN mode where the stop system is disengaged and the electric motor is actuated, causing the balloon string reel to rotate in the second direction, and a BRAKE mode where the stop system is disengaged and the plurality of gears are engaged so that balloon string is not drawn out from the balloon string reel and the balloon string reel does not rotate unless tension on the balloon string is high enough to cause the plurality of gears to slip relative to each other;

descending the helium-filled balloon by drawing in the balloon string and helium-filled balloon by rotating the balloon string reel through the electric motors and gear assembly; and urging the gear assembly together with a force sufficient for engaging the plurality of gears together for driving rotation of the balloon string reel for drawing in the balloon string and helium-field balloon and sufficient for allowing the plurality of gears to slip relative to each other if tension on the balloon string becomes too high.

6. The method of using the balloon toy of claim 5, further including:

ascending the helium-filled balloon by letting out the balloon string from the balloon string reel and rotating the balloon string reel in a direction opposite to a direction for drawing in the balloon string; and preventing significant rotation of the balloon string reel in the direction for drawing in the balloon string and recoiling of the balloon string on the balloon string reel as the helium-filled balloon rises with a stop system.

7. The method of using the balloon toy of claim 6, further including actuating a DOWN mode in the balloon toy, the DOWN mode disengaging the stop system and actuating the electric motor to cause the balloon string reel to rotate to draw in the balloon string and the helium-filled balloon.

8. The method of using the balloon toy of claim 7, further including actuating a BRAKE mode in the balloon toy, the BRAKE mode disengaging the stop system and engaging the plurality of gears so that balloon string is not drawn out from the balloon string reel and the balloon string reel does not rotate unless tension on the balloon string is high enough to cause the plurality of gears to slip relative to each other.

9. The method of using the balloon toy of claim 8, further including a rocker switch having at least the UP mode, the DOWN mode, and the BRAKE mode, which are mutually exclusive, and the method further includes moving the switch to one of the UP mode, the DOWN mode, and the BRAKE mode.

* * * * *